US007025095B2

(12) United States Patent
Zils

(10) Patent No.: US 7,025,095 B2
(45) Date of Patent: Apr. 11, 2006

(54) PAPER MACHINE CLOTHING

(75) Inventor: Frank Zils, Morzenich (DE)

(73) Assignee: Heimbach GmbH & Co., Duren (DE)

( * ) Notice: Subject to any disclaimer, the term of this patent is extended or adjusted under 35 U.S.C. 154(b) by 190 days.

(21) Appl. No.: 10/786,112

(22) Filed: Feb. 26, 2004

(65) Prior Publication Data

US 2004/0168737 A1 Sep. 2, 2004

(30) Foreign Application Priority Data

Feb. 27, 2003 (DE) ..... 103 08 826

(51) Int. Cl.
*D03D 11/00* (2006.01)

(52) U.S. Cl. ..... 139/383 AA; 139/383 A; 139/408; 139/410

(58) Field of Classification Search ..... 139/383 A, 139/383 AA, 410, 408
See application file for complete search history.

(56) References Cited

U.S. PATENT DOCUMENTS 4,103,717 A * 8/1978 Clark ..... 139/383 A
4,364,421 A * 12/1982 Martin ..... 139/383 AA
4,574,435 A * 3/1986 Luciano et al. ..... 24/33 C
4,887,648 A * 12/1989 Cunnane ..... 139/383 AA
4,896,702 A * 1/1990 Crook ..... 139/383 A
5,015,220 A 5/1991 Legge et al.
5,904,187 A * 5/1999 Davenport ..... 139/383 AA
6,213,164 B1 * 4/2001 Ostermayer et al. .. 139/383 AA
6,302,155 B1 * 10/2001 Rydin ..... 139/383 AA
6,776,878 B1 * 8/2004 Yook ..... 162/358.2

FOREIGN PATENT DOCUMENTS

| | | |
|---|---|---|
| EP | 0 984 098 B1 | 6/2003 |
| JP | 11200275 | 7/1999 |
| WO | WO 00/09802 | 2/2000 |

* cited by examiner

*Primary Examiner*—John J. Calvert
*Assistant Examiner*—Robert H Muromoto
(74) *Attorney, Agent, or Firm*—Berenato, White & Stavish, LLC

(57) ABSTRACT

The invention refers to a paper machine clothing (1) having a support (2) made of at least two support plies (3, 4) which each comprise longitudinal and transverse yarns (5, 6, 7, 8) but are essentially not connected to one another via their surface by means of yarns. Seam loops (11, 12) comprising longitudinal yarns (7, 8) connect the ends (9, 10) to form a seam by means of a pintle wire (14) slid through the seam loops (11, 12), project at the front ends (9, 10) of the paper machine clothing (1). The paper machine clothing according to the present invention is characterized in that the support plies (3, 4) are connected to one another via binding transverse yarns (15 through 20) whose arrangement is confined to the region of the two ends (9, 10) of the paper machine clothing (1) adjacent to the seam loops (11, 12).

9 Claims, 1 Drawing Sheet

PAPER MACHINE CLOTHING

CROSS-REFERENCE TO RELATED APPLICATION AND CLAIM TO PRIORITY

This application claims the benefit under 35 U.S.C. § 119 of application number 103 08 826.1-27, filed Feb. 27, 2003, in the Federal Republic of Germany, the disclosure of which is incorporated herein by reference.

FIELD OF THE INVENTION

The invention concerns a paper machine clothing having a support made of at least two support plies which each comprise longitudinal and transverse yarns but are essentially not connected to one another via their surface by means of yarns, in which context seam loops comprising longitudinal yarns, which loops serve to connect the ends to form the seam by means of a pintle wire slid through the seam loops, project at the front ends of the paper machine clothing.

BACKGROUND OF THE INVENTION

There is known in the existing art a species of paper machine clothings for use in a paper machine, in which a support fabric comprising two woven support plies is present; the support plies are not, however, being connected to one another via their surface by yarns. At the front ends of the paper machine clothing, the support plies are connected via their longitudinal yarns to form seam loops. By way of these seam loops, the ends can be coupled by the fact that the seam loops of the two ends are made to overlap and a so-called pintle wire is slid through the seam loops in the overlap region. Such paper machine clothings may be inferred, for example, from WO 00/09802 and JP 112 00 275.

A method suitable for manufacturing paper machine clothings of this kind is described in U.S. Pat. No. 5,015,220. In this method, a single-ply support fabric is circular-loom woven, specifically with a circumference that is twice as great as the intended length of the paper machine clothing, and is then equipped with a needled-on fiber batt. The tubular structure thus obtained is then pressed together so that two superimposed plies are produced. By fringing at the front ends, seam loops are exposed from the longitudinal yarns present there and can be overlapped in order to connect the ends.

Because of the particular support construction, such paper machine clothings offer high strength, in particular also in the seam region, since the seam loops are constituted by longitudinal yarns extending endlessly over the support plies. This support construction is furthermore characterized by low compressibility as compared with double-ply supports, with the consequence that dewatering properties remain largely constant over the service life of the paper machine clothings. The unsatisfactory stability in the seam region is, however, disadvantageous. In addition, fiber batt anchoring in that region is not optimal.

SUMMARY OF THE INVENTION

It is the object of the invention to configure a paper machine clothing of the kind cited initially in such a way that seam stability is enhanced, and improved anchoring of the fiber batt is achievable.

According to the present invention, this object is achieved in that the support plies are connected to one another via binding transverse yarns whose arrangement is confined to the region of the two ends of the paper machine clothing adjacent to the seam loops. Binding transverse yarns can be present which do not increase the yarn density of the transverse yarns, i.e. are in any case present as transverse yarns in the support plies, but which, unlike the other transverse yarns, are guided so that they also engage into respective adjacent support plies. Alternatively thereto or in combination therewith, however, it is also possible to provide binding transverse yarns that are woven in in addition to the transverse yarns extending in the support plies, and that therefore increase the yarn density in the regions adjacent to the seam loops.

A paper machine clothing of this kind is characterized by high stability in the seam region. This is because the seam loops are closed by the binding yarns on the support side, and shifting of the support plies is blocked. Aside from this, anchoring of the fiber batt in this region is considerably improved. Both results are achieved without otherwise disadvantageously intervening in the structure of the support, i.e. the advantages of this support construction are entirely retained.

The type of connection, i.e. the manner in which the binding transverse yarns are guided, can be adapted within broad limits to the particular requirements. For example, binding transverse yarns can be present that alternately engage a longitudinal yarn in the one support ply, and a longitudinal yarn that is offset by one longitudinal yarn in the adjacent support ply. This results in very secure connection of the support plies. Binding transverse yarns can also be present, however, that go over several longitudinal yarns in the support plies—either in longitudinally floating fashion or so as to engage the longitudinal yarns—before switching from one support ply to an adjacent support ply. Binding transverse yarns that engage differently can also be combined with one another. It is advantageous in this context that two adjacent binding transverse yarns have a mirror-image routing.

Adaptation to particular requirements is advantageous and possible with regard to the number of binding transverse yarns as well. At least one binding transverse yarn, preferably two to four binding transverse yarns, should be present at each end of the paper machine clothing. There can also be up to ten binding transverse yarns, however, if particularly stringent demands exist in terms of the strength of the seam connection.

Thermoplastic polymers are primarily suitable as the material for the binding transverse yarns, for example polypropylene, polyamide 4.6, polyamide 6, polyamide 6.6, polyamide 6.10, polyamide 6.12, polyamide 11, polyamide 12, PET, PTT, PBT, PPS, PEK, PEEK, or polyester. In accordance with the demands on the binding transverse yarns, a material that differs from the material of the other transverse yarns can be used. It is understood that the binding transverse yarns can be embodied as monofilaments or multifilaments.

The number of seam loops is defined in accordance with the particular requirements. It is entirely possible for all the longitudinal yarns to constitute seam loops. An advantageous variant consists, however, in the fact that at least one longitudinal yarn constituting a seam loop alternates with at least one longitudinal yarn that does not constitute a seam loop; and that the seam loops of the ends of the paper machine clothing are offset from one another in the transverse direction so that the seam loops can readily mesh in comb fashion with one another.

DESCRIPTION OF THE DRAWINGS

The invention is illustrated in more detail, with reference to exemplary embodiments, in the drawings, in which.

DETAILED DESCRIPTION OF THE PREFERRED EMBODIMENT(S)

Figure 1:
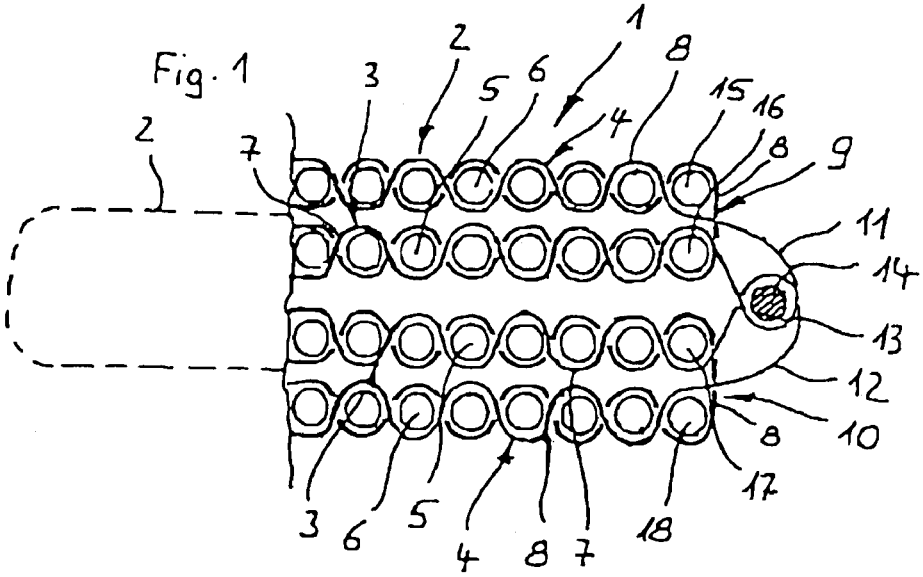
FIG. 1 is a longitudinal section through the paper machine clothing according to the present invention, limited to the seam region.

Wet press felt 1 depicted schematically in FIG. 1 is intended for use in the press section of a paper machine. For reasons of clarity, only support 2 of wet press felt 1 is visible. The yarn plies embedding support 2 are omitted. Support 2 is only partially depicted here. It continues to the left in the form of a horizontal U (indicated here with dashes), so that support 2 in its entirety represents a horizontal U. The extent of the U is adapted to the particular installation conditions in the paper machine.

Support 2 comprises an internal support ply 3 and an external support ply 4. Both support plies 3, 4 are embodied as fabrics that are manufactured in a continuous weaving process by circular-loom weaving. The fabrics have transverse yarns (labeled 5 and 6 by way of example), which formed the warp yarns in the weaving process, as well as longitudinal yarns 7, 8 as weft yarns. Longitudinal yarns 7, 8, because of their property as weft yarns, are parts of one single continuous yarn. Transverse yarns 5, 6 engage with longitudinal yarns 7, 8 in such a way that the two support plies 3, 4 have via the surface no connection with one another by way of yarns, i.e. transverse yarns 5 do not engage into support ply 4 and transverse yarns 6 do not engage into support ply 3, and longitudinal yarns 7, 8 remain in the respective support ply 3, 4 over the entire length of support 2.

At front ends 9, 10 of support 2, every second longitudinal yarn 7, 8 constitutes seam loops 11, 12 that project beyond ends 9, 10. This creates, perpendicular to the drawing plane, a plurality of seam loops 11, 12 (cf. in this context reference numbers 17 and 19 in FIG. 2 of WO 00/09802 and reference numbers 20, 22 in FIGS. 2 through 5 of U.S. Pat. No. 5,015,220). Longitudinal yarns 7, 8 that extend respectively between two longitudinal yarns 7, 8 forming seam loops 11, 12 are turned back over a short distance without forming seam loops.

The one row of seam loops 11 is made to overlap in comb fashion, as depicted, with the other row of seam loops 12, so that a passthrough channel 13 is formed perpendicular to the drawing plane. By sliding a pintle wire 14 through passthrough channel 13, seam loops 11, 12 and thus ends 9, 10 of support 2 are coupled to one another, so that an endless support 2 and thus also an endless wet press felt 1 are created. Coupling occurs after wet press felt 1 is pulled into the press section of the paper machine.

In a deviation from the existing art cited above, the first two respective transverse yarns at ends 9, 10 adjacent to seam loops 11, 12 are embodied as binding transverse yarns 15, 16, 17, 18. The difference in routing compared with transverse yarns 5, 6 is not evident from FIG. 1, but is apparent from the cross section depicted in FIG. 2. Binding transverse yarns 15, 16, 17, 18 are depicted there in enlarged fashion to illustrate their routing as compared with the routing of the other transverse yarns 5, 6. Whereas the other transverse yarns 5, 6 engage in a plain weave with longitudinal yarns 7, 8 exclusively in support ply 3 or support ply 4, respectively, binding transverse yarns 15, 16, 17, 18 run in such a way that they engage alternately into both support plies 3, 4, specifically around one longitudinal yarn in the one support ply 3 and—offset two longitudinal yarns 7, 8—around one longitudinal yarn 8 in the other support ply 4. As a result of this routing of binding transverse yarns 15, 16, 17, 18, seam loops 11, 12 are closed on the support side.

Figure 2:
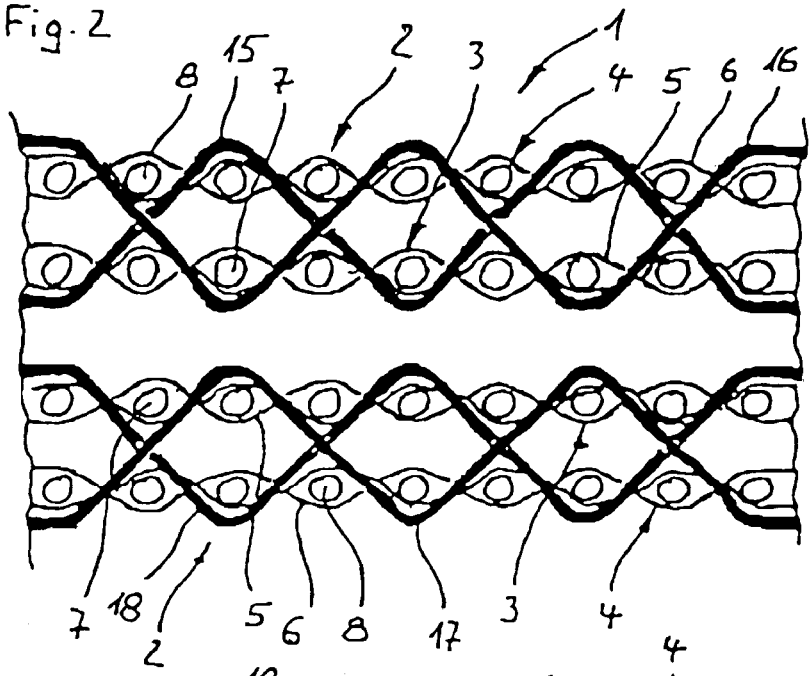
FIG. 2 is a cross section through the paper machine clothing according to FIG. 1, in an enlarged depiction.
Figure 3:
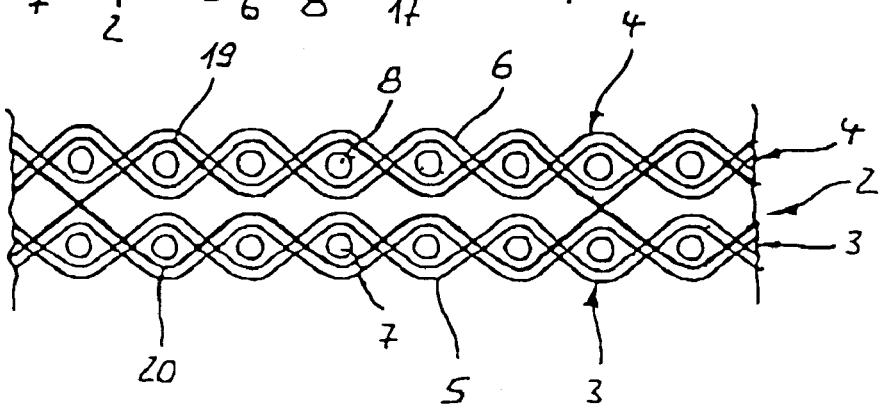
FIG. 3 is a cross section through a variant of the paper machine clothing according to FIG. 1.

FIG. 3 shows a variant of support 2 according to FIGS. 1 and 2, only half of the cross section depicted in FIG. 2 being shown. Binding transverse yarns 19, 20 are present here and once again run in mirror-image fashion; but unlike in the version according to FIG. 2, they alternate at substantially larger intervals between support plies 3, 4. Between them, they run over longitudinal yarns 7, 8 and engage them in the manner of a plain weave. It is understood that as a result, the connection of the two support plies 4, 5 is less tight than in the version shown in FIG. 2.

I claim:

1. A paper machine clothing (1) having a support (2) made of at least two support plies (3, 4) which each comprise longitudinal and transverse yarns (5, 6, 7, 8) but are essentially not connected to one another via their surface by means of yarns, in which context seam loops (11, 12) comprising longitudinal yarns (7, 8), which loops serve to connect the ends (9, 10) to form a seam by means of a pintle wire (14) slid through the seam loops (11, 12), project at the front ends (9, 10) of the paper machine clothing (1), wherein the support plies (3, 4) are connected to one another via binding transverse yarns (15 through 20) whose arrangement is confined to the region of the two ends (9, 10) of the paper machine clothing (1) immediately adjacent to the seam loops (11, 12).

2. The paper machine clothing as defined in claim 1, wherein binding transverse yarns (15 through 20) are present that do not increase the yarn density of the transverse yarns (5, 6).

3. The paper machine clothing as defined in claim 1, wherein binding transverse yarns are present in addition to the transverse yarns extending in the support plies.

4. The paper machine clothing as defined in claim 1, wherein binding transverse yarns (15 through 18) are present that alternately engage a longitudinal yarn (7) in the one support ply (3), and a longitudinal yarn (8) that is offset by at least one longitudinal yarn (7, 8) in the adjacent support ply (4).

5. The paper machine clothing as defined in claim 1, wherein binding transverse yarns (19, 20) are present that go over several longitudinal yarns (7, 8) in the support plies (3, 4) before switching from one support ply (3) to an adjacent support ply (4).

6. The paper machine clothing as defined in claim 1, wherein two adjacent binding transverse yarns (15, 16 and 17, 18 and 19, 20) have a mirror-image routing.

7. The paper machine clothing as defined in claim 1, wherein at least one binding transverse yarn, preferably two to four binding transverse yarns (15, 16 and 17, 18 and 19, 20) are present at each end (9, 10) of the paper machine clothing (1).

8. The paper machine clothing as defined in claim 1, wherein all the longitudinal yarns (7, 8) constitute seam loops (11, 12).

9. The paper machine clothing as defined in claim 1, wherein at least one longitudinal yarn (7, 8) constituting a seam loop (11, 12) alternates with at least one longitudinal yarn (7, 8) that does not constitute a seam loop (11, 12); and the seam loops (11, 12) of the ends of the paper machine clothing (1) are offset from one another in the transverse direction.

* * * * *